US006058759A

United States Patent [19]

Wilson

[11] Patent Number: 6,058,759

[45] Date of Patent: May 9, 2000

[54] WHEEL NUT LOCK BENDER

[76] Inventor: Anthony L Wilson, 5355 Provo Rd., Provo, Ky. 42267

[21] Appl. No.: 09/267,407

[22] Filed: Mar. 12, 1999

[51] Int. Cl.[7] ..... B21J 13/08; B25B 1/06

[52] U.S. Cl. ..... 72/479; 72/458; 81/176.3

[58] Field of Search ..... 72/457, 458, 479; 81/176.3

[56] References Cited

U.S. PATENT DOCUMENTS

| | | | |
|---|---|---|---|
| 1,814,435 | 7/1931 | De Laney | 72/458 |
| 2,616,317 | 11/1952 | Hakkerup | 72/458 |
| 3,113,478 | 12/1963 | Hall, Jr. et al. | 72/457 |
| 3,908,438 | 9/1975 | Norden | 72/458 |
| 4,672,836 | 6/1987 | Wilkinson et al. | 72/479 |

*Primary Examiner*—David Jones
*Attorney, Agent, or Firm*—Bryan LeSieur

[57] ABSTRACT

Wheel nut lock bending tool used to outwardly bend the lock washer tabs of a wheel nut locking assembly in the recessed and confined space of the wheel hub. The tool is threaded and attached to a slide hammer so that sufficient force can be applied to the working face of the tool to bend the lock washer tangs outwardly over the flat of the outer nut.

2 Claims, 2 Drawing Sheets

WHEEL NUT LOCK BENDER

CROSS REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

This invention relates to a simple wheel nut lock bending tool used to efficiently bend the tangs of a locking washer over the flat side of a wheel nut, in a wheel hub assembly.

The particular type of wheel assembly is found on certain buses and medium duty trucks manufactured by NAVISTAR.

Said wheel hub assembly is a common method for locking a wheel nut onto an axle to avoid inadvertent loosening of the wheel nut due to motion and vibrations associated with wheel movement.

The nut and locking washer are recessed into the well of the wheel hub. It is extremely difficult to laterally access and bend the tangs on the lock washer with tools that are presently in use such as screwdrivers and pry bars.

The locking washers are made of hardened steel and require many foot pounds of force to be applied to the tangs in order to outwardly bend them over the flat side of the outer nut.

BRIEF SUMMARY OF THE INVENTION

This invention is directed to a wheel nut lock bending tool to be used to insert into the confined space of the recessed wheel hub lock nut assembly of Navistar or other similar buses and medium duty trucks behind the lock washer tang. In the said assemblies, the lock washer is sandwiched between an inner and an outer lock nut.

Sufficient outward force is applied by the use of a slide hammer to which the tool is distally attached by means of a threaded bore. The force thus applied therefore bends the lock washer tang outwardly over the flat of the outer lock nut. Proper locking of said nut requires that no less than two such tangs be so bent.

The primary advantage of this invention is the tool's ability to efficiently laterally access the rear of the lock washer tang in the very confined space of the wheel hub assembly, and to be used to apply sufficient force to outwardly bend such tangs.

The invention is simple, inexpensive and efficient.

BRIEF DESCRIPTION OF THE VIEW OF THE DRAWINGS

FIG. 1. is a downward looking view of the top surface of the wheel nut lock bender.

FIG. 2. is a side view of the wheel nut lock bender showing the tapered distal end.

FIG. 3. is the end view of the distal tip showing the milled arc on top. Said arc is milled to correspond to the interior curvilinear arc of the wheel hub.

FIG. 4. Is a view of the wheel hub assembly with a portion of the hub (1.) sectioned away. This figure shows the wheel nut lock bender 8. in position at the commencement of the bending operation, where 1. is the cutaway wheel hub; 2. is the wheel bearing race; 3. is the wheel bearing; 4. is the threaded wheel spindle; 5. is the inner wheel hub lock nut; 6. is the wheel nut lock washer; 7. is the outer wheel hub nut.

DETAILED DESCRIPTION OF THE INVENTION

Figure 1:
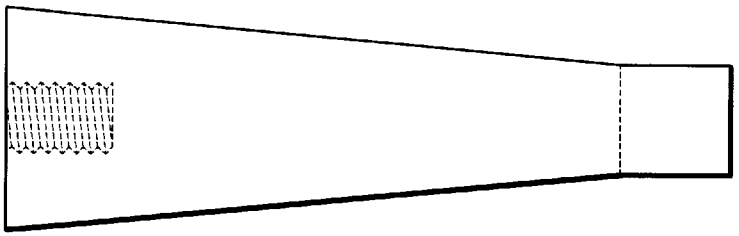
Figure 2:
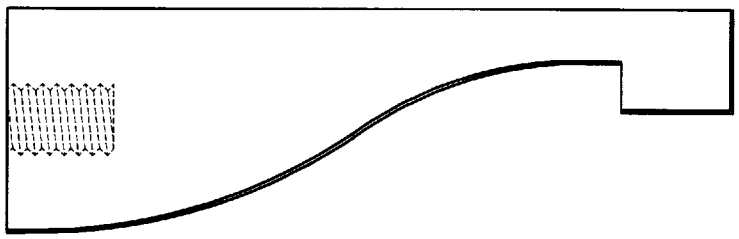
Figure 3:
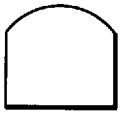

Now referring to the drawings, the wheel nut lock bender comprises a milled hardened steel body, machined from a cylindrical rod.

Typically, the tool has an overall length of 2½ inches. The tail-end of the tool being cylindrical and having a diameter of ¾ inch, and being internally bored to a sufficient depth with a ½ inch threaded (tapped) bore. The distal tip is $^{38}/_{100}$ inch across and $^{35}/_{100}$ inch from the milled arced top to the bottom. The milled arc corresponding to the arc of the wheel hub. The tail-end tapering toward the distal tip such that the neck is $^{18}/_{100}$ inch from top to bottom.

Figure 4:
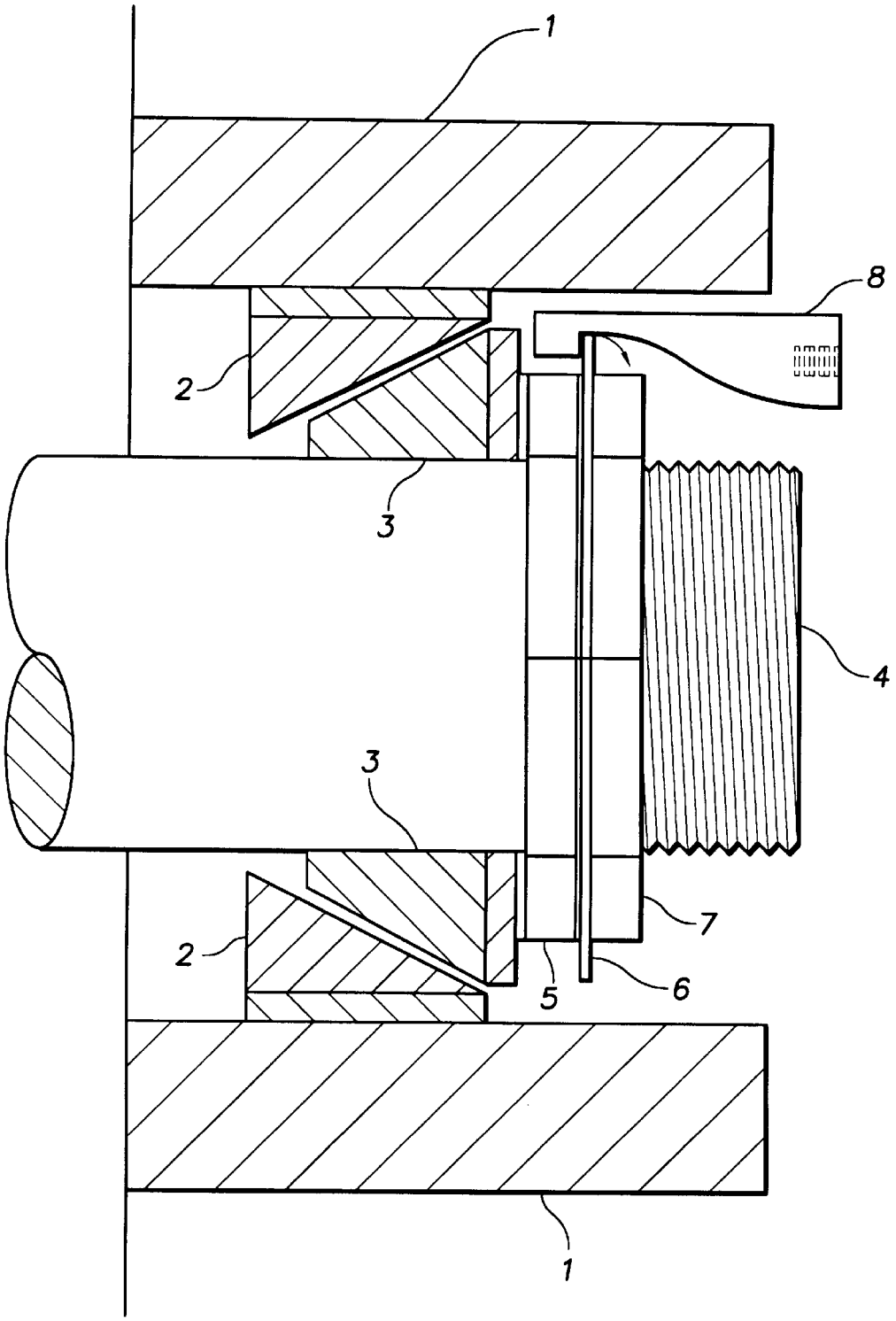

FIG. 4 shows the wheel nut lock bender 8, as inserted into the confined annular space between the inner curvilinear wall of the wheel hub 1. and the lock washer 6 and lock nuts 5 and 7. The tool 8 is applied to the inner face of the lock washer tang 6, said washer being sandwiched between the inner lock nut 5 and the outer lock nut 7, both of which are threaded onto the wheel spindle 4 and all of which is seated against the wheel bearing assembly 2/3.

Outward force is applied by the use of a cylindrical heavy metal hammer with an inner bore fitted over a cylindrical shaft of a minimally smaller diameter than said bore so that the said hammer is slidable along the length of the shaft. The said shaft being of sufficient length to allow said hammer to strike the surface of a rear retainer and thereby exert a sufficient equivalent force on the forward end of said shaft which is threaded into the tapped bore in the tail-end of the tool 8.

What is claimed is:

1. A tool for the purpose of bending a lock washer tang outwardly over the outer nut of a wheel nut lock assembly wherein said assembly is recessed into a wheel hub well with insufficient annular space between said well's inner surface and the washer tangs to allow lateral approach, and wherein the locking washer is sandwiched between two hex nuts on the threaded axle shaft; said tool comprising a solid hardened milled steel tool with a cylindrical rearward end of ¾ inch diameter, bored and threaded, and having a tapered distal end with a milled working surface to insert behind the locking washer, and the distal tip of said tool being milled into an arc to correspond to the inner curvilinear wall of the wheel hub well.

2. The tool of claim 1 wherein said tool is permanently affixed to a slide hammer.

* * * * *